US007201031B2

(12) United States Patent
Shuey et al.

(10) Patent No.: US 7,201,031 B2
(45) Date of Patent: Apr. 10, 2007

(54) FLANGING PROCESS IMPROVEMENT FOR REDUCING VARIATION IN CAN BODY FLANGE WIDTH

(75) Inventors: Dennis Shuey, Fishersville, VA (US); Mihail Dinu, Lynchburg, VA (US); Terry Babbitt, Lynchburg, VA (US); Joseph G. Schill, Lynchburg, VA (US)

(73) Assignee: Belvac Production Machinery, Inc., Lynchburg, VA (US)

( * ) Notice: Subject to any disclaimer, the term of this patent is extended or adjusted under 35 U.S.C. 154(b) by 0 days.

(21) Appl. No.: 11/051,474

(22) Filed: Feb. 7, 2005

(65) Prior Publication Data

US 2005/0252264 A1 Nov. 17, 2005

Related U.S. Application Data

(60) Provisional application No. 60/541,917, filed on Feb. 6, 2004.

(51) Int. Cl.
*B21B 15/00* (2006.01)

(52) U.S. Cl. ..... 72/126; 72/94; 72/379.4

(58) Field of Classification Search ..... 72/84, 72/94, 112, 115, 118, 126, 379.4; 413/69, 413/73

See application file for complete search history.

(56) References Cited

U.S. PATENT DOCUMENTS 3,688,538 A * 9/1972 Hoyne ..... 72/94
4,341,103 A 7/1982 Escallon et al.
4,512,172 A * 4/1985 Abbott et al. ..... 72/68
4,747,287 A * 5/1988 Azzaline et al. ..... 72/125
4,870,847 A 10/1989 Kitt
5,121,621 A 6/1992 Ihly
5,150,595 A 9/1992 Ihly
5,235,839 A 8/1993 Lee, Jr. et al.
5,245,848 A 9/1993 Lee, Jr. et al.
5,282,375 A 2/1994 Lee, Jr. et al.
5,353,619 A 10/1994 Chu et al.
5,465,599 A * 11/1995 Lee, Jr. ..... 72/94
5,467,628 A 11/1995 Bowlin et al.
5,634,364 A 6/1997 Gardner et al.
5,676,006 A 10/1997 Marshall
5,713,235 A 2/1998 Diekhoff
5,755,130 A 5/1998 Tung et al.
5,775,161 A * 7/1998 Caleffi et al. ..... 72/356
5,853,275 A * 12/1998 Lentz et al. ..... 413/73
5,934,127 A 8/1999 Ihly
5,996,386 A * 12/1999 Pazzaglia ..... 72/84
6,167,743 B1 1/2001 Marritt et al.
6,220,073 B1 4/2001 Cheng et al.
6,752,000 B2 6/2004 Reynolds et al.

* cited by examiner

*Primary Examiner*—Ed Tolan
(74) *Attorney, Agent, or Firm*—Foley & Lardner LLP

(57) ABSTRACT

A flange forming process uses first and second stages. The first stage produces a partially formed flange on an article. The second stage forces the partially formed flange into a die so a stepped surface of a knockout punch that is disposed in the die, produces a predetermined can height such as the FFCH (Factory Finished Can Height) while the retaining die limits the outside diameter of the flange.

18 Claims, 12 Drawing Sheets

FLANGING PROCESS IMPROVEMENT FOR REDUCING VARIATION IN CAN BODY FLANGE WIDTH

BACKGROUND OF THE INVENTION

This application claims priority to Provisional Application No. 60/541,917 filed on Feb. 6, 2004, the entire content of which is hereby incorporated by reference thereto.

Flanging is the process used to roll the open end of the body on a typical 2-piece beverage or food can, in preparation for the filling operation. The flange material, basically perpendicular to the axial centerline of the can, is rolled to create a double seam with the lid after the can has been filled. The final width of the flange is critical in ensuring the seam has sealed the pressurized contents of the container properly.

The flange is dimensionally defined by the following criteria: (See FIGS. 1A, 1B and 1C)

Plug Diameter—the upper inside diameter of the can that must match precisely with the filler's equipment.

Under Flange Radius—the radius formed between the can body and the flange.

Flange Angle—the angle of the flange normal to the dome (stand) of the can.

Flange Width—the width of the flange from inside diameter to the flange outside diameter.

Single stage, in-line flanging equipment on cascading, fixed-base and modular necking systems are known as are stand-alone flanger machines where no necking process is required. Flanging also takes place after conventional necking processes. Flanging on known equipment has been accomplished with two basic types of tooling.

1) Axial Spinheads—these assemblies, as shown in FIGS. 2A and 2B, typically consist of 3 or more free-spinning rollers whose axes are parallel to the centerline of the can body. The stationary can is driven axially into the assembly while the spinhead rotates. The rollers are profiled to create the flange matching given specifications and can be accomplished on a number of different neck diameters.

2) Radial Spinheads—the radial spinhead design typically incorporating 3 or 4 free-spinning rollers, was introduced in 1996 as an alternative to the axial system. The rollers in this assembly are positioned perpendicular to the axial centerline of the can body, with the stationary can and rotating spinhead concept remaining the same. This design has been provided on systems which are commercially available necking systems and available from Belvac Production Machinery, Inc. (Belvac®—located in Virginia) since 1996, with the exception of those producing a quad-neck or the like configuration.

The following process improvements were realized with the configuration of the nature depicted in FIGS. 3A and 3B. By way of example, the arrangement show in FIG. 3A is configured to have (merely by way of example) a theoretical plug diameter of 2.260" and a roller radius of RO.0600". On the other hand, the arrangement shown in FIG. 3B is configured for a different can neck size, and has (merely by way of example) a theoretical plug diameter of 2.160" and a roller radius of RO.0600". These arrangements produce the following advantages.

Reduced process loads

Minimized the amount of stretching of the final plug diameter

Minimized deformation of the neck profile

Greater control of flange angle, width, and factory finished can height (FFCH)

Produced a smaller under flange radius

With both spinhead assembly designs, the final flange geometry is determined by the profile of the rollers. (See FIG. 4 for a typical geometry). No positive limit is used to control the size of the flange outside diameter. The best that can be expected with use of the radial spinheads, as far as flange width variation is concerned, is an amount equal to or slightly less than that of the incoming can final neck height variation.

SUMMARY OF THE INVENTION

The embodiments of the invention are directed to improving this process by decreasing dimensional variation in specified final flange width. This is accomplished with a 2-stage process. Additionally, reduction in variation in FFCH is realized with this process.

The proposed new process greatly improves the dimensional variation in final flange width by absorbing the neck height variation within the flange geometry.

Testing has shown this process reduces the effect of incoming can height variation by up to approximately 60%–70%, thus producing a more consistent final flange width. The following are also noted:

Variation in FFCH has been reduced

Resultant smaller under flange radius

More specifically, a first aspect of the invention resides in a flange forming process comprising first and second stages. The first stage comprises forming a partially formed flange on a can. The second stage comprises modifying the partially formed flange by forcing the partially formed flange into a die so that a stepped surface of a knockout punch that is disposed in the die, produces a predetermined can height and so that a retaining die which is disposed with the knockout punch, limits the size of the flange outside diameter to a specified flange outer diameter.

In one embodiment of the invention, the above mentioned step of producing the partially formed flange comprises using a radial spinhead having a plurality of rollers which each have a profile configured to partially form the flange. Each of the plurality of rollers is configured (in one embodiment of the invention) to have an exit angle of about 30–40 degrees. Of course, the use of other types of spin heads (e.g. axial spin heads) and other exit angles are not excluded from the scope of the invention, the quoted angle of about 30° to about 40° being exemplary of a suitable angle.

The above mentioned retaining die is configured to have an inside diameter equaling a predetermined flange outside diameter and further has a lead-in angle with a radius sufficient to avoid interference with the incoming flange. The center knockout punch has an outside diameter equaling a predetermined final plug diameter and a stepped surface which has a predetermined angle with respect to the axis of the center knockout punch. This angle, depending on the embodiment, can vary from about 0 to about 3 degrees off perpendicular with respect to the axis of the center knockout punch. In this instance also, this predetermined angle is not limited to the quoted valued and can be varied if required.

In accordance with the above mentioned aspect of the invention, the second stage of the process is such that the retaining die and the can are maintained in a non-relative rotational relationship with respect to one another using a pressure differential, such as pneumatic pressure differential. Further, the above-mentioned step of modifying comprises forcing the partially formed flange into the die so that the flange engages the stepped surface of the knockout and shapes the flange in a manner to produce the predetermined can height and so that the retaining die limits the size of the flange outside diameter during the modification.

In accordance with an embodiment of the invention, the flange forming process as noted above, is such that the first and second stages are carried out in first and second turrets respectively. The cans are moved from the first turret to the second turret after the partially formed flange is formed.

A second aspect of the invention resides in a flange forming arrangement comprising first and second stages. The first stage comprises a spinhead having a plurality of rollers with profiles configured to produce a partially formed flange on a can. The second stage, on the other hand, comprises a center knockout punch with an outside diameter equal to a specified final plug diameter of the can, and a stepped surface. The stepped surface has a predetermined angle with respect to an axis of the center knockout punch, while a retaining is die disposed with the center knockout punch. The retaining die has an inside diameter equal to a specified flange outside diameter and a lead-in angle with a radius configured to ensure the incoming flange is free of engagement with the second retaining die until it reaches the stepped surface.

In one embodiment of the above arrangement, the rollers of the first stage each have a configuration wherein the exit angle is about 30–40 degrees. The subsequent second stage is arranged so that the partially formed flange, formed by using a radial spin head for example, is received in the retaining die and is advanced thereinto so that the stepped surface produces a predetermined can height, and so that the retaining die limits the size of the flange outside diameter to the specified flange outside diameter.

In accordance with this aspect of the invention, the predetermined angle of the stepped surface is about 0 to about 3 degrees off perpendicular with respect to the axis of the center knockout punch.

In this aspect of the invention the first stage is also mounted on a first turret and wherein the second stage is mounted on a second turret.

Although the means (i.e. the spin head) for forming the partially formed flange is mentioned above as being a radial spin head, it is not outside of the scope of the invention to use an axial spin head in its place.

BRIEF DESCRIPTION OF THE DRAWINGS

The various features and advantages of the embodiments of the invention will become more clearly appreciated as a description of the preferred embodiments is given with reference to the appended drawings in which.

DESCRIPTION OF THE PREFERRED EMBODIMENTS

Unlike the current single-stage process, the improved flange according to the embodiment of the present invention is created in two steps or stages, requiring two full turrets on a typical necking system marketed by Belvac Production Machinery, Inc. (Belvac®).

Stage-1

This consists of a radial spinhead 100 utilizing 3 rollers 101 with modified profiles that produce a partially formed flange. The typical 7-degree exit angle has been increased to 30–40 degrees (for example) while the form radius has retained its original dimension. As in the conventional flanger operation, compressed air enters the can (not shown) through the center of a tool mounting bolt (not shown) and ensures the dome of the can maintains contact against the push-plate to aid in transferring the can into and out of the flanger turret. The compressed air stabilizes the can during the flanging operation and aids in ensuring that the can is biased against the push plate during retraction.

Vacuum is timed precisely to hold the dome of the can securely against the pliable insert on the push-plate to prevent the can from rotating during the flanging process. As with conventional flanging, the stationary can is pushed axially into the rotating spin head. The flange is formed as the open end is forced over and around the profile of the rollers.

Figure 6A:
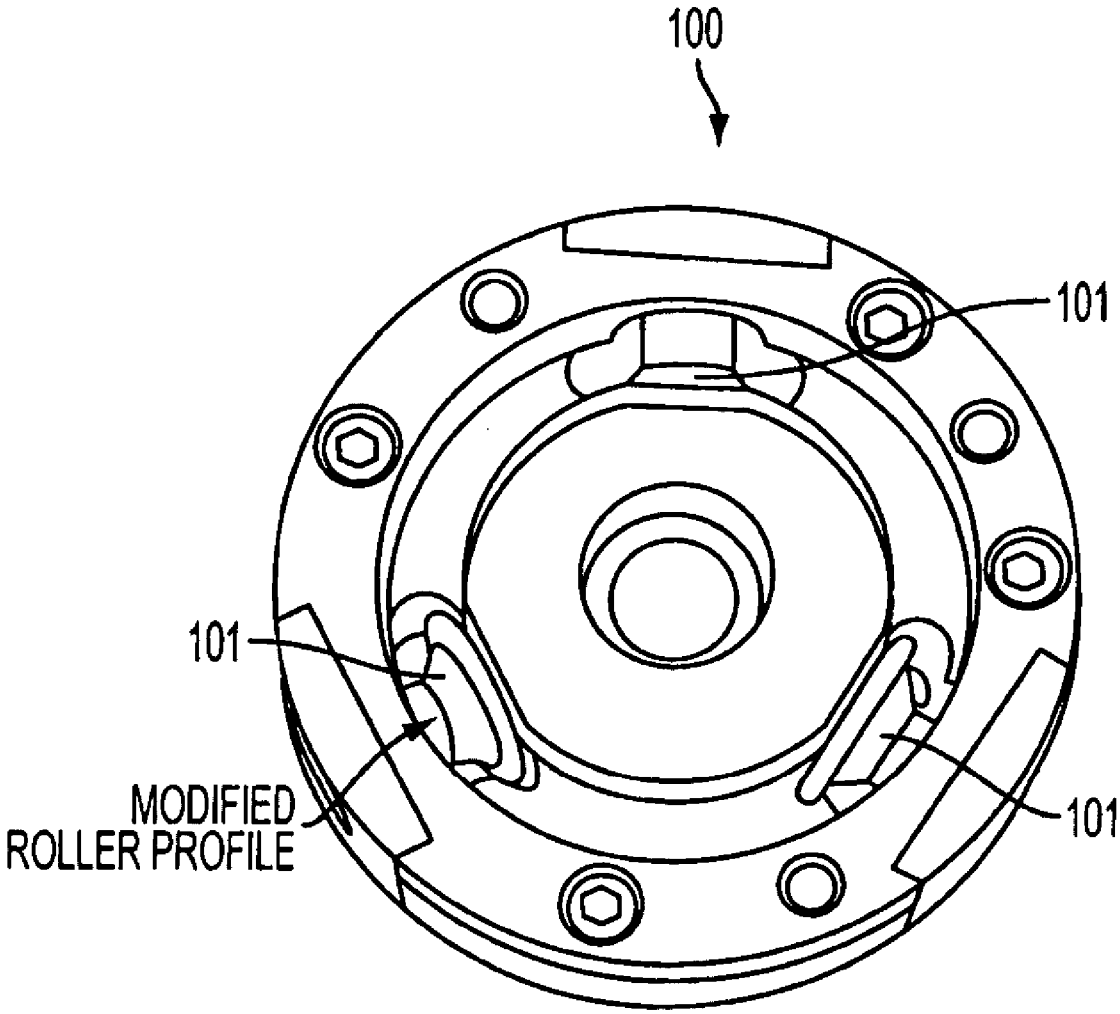
FIG. 6A is a perspective view showing features of a $1^{st}$ stage radial spinhead.
Figure 6B:
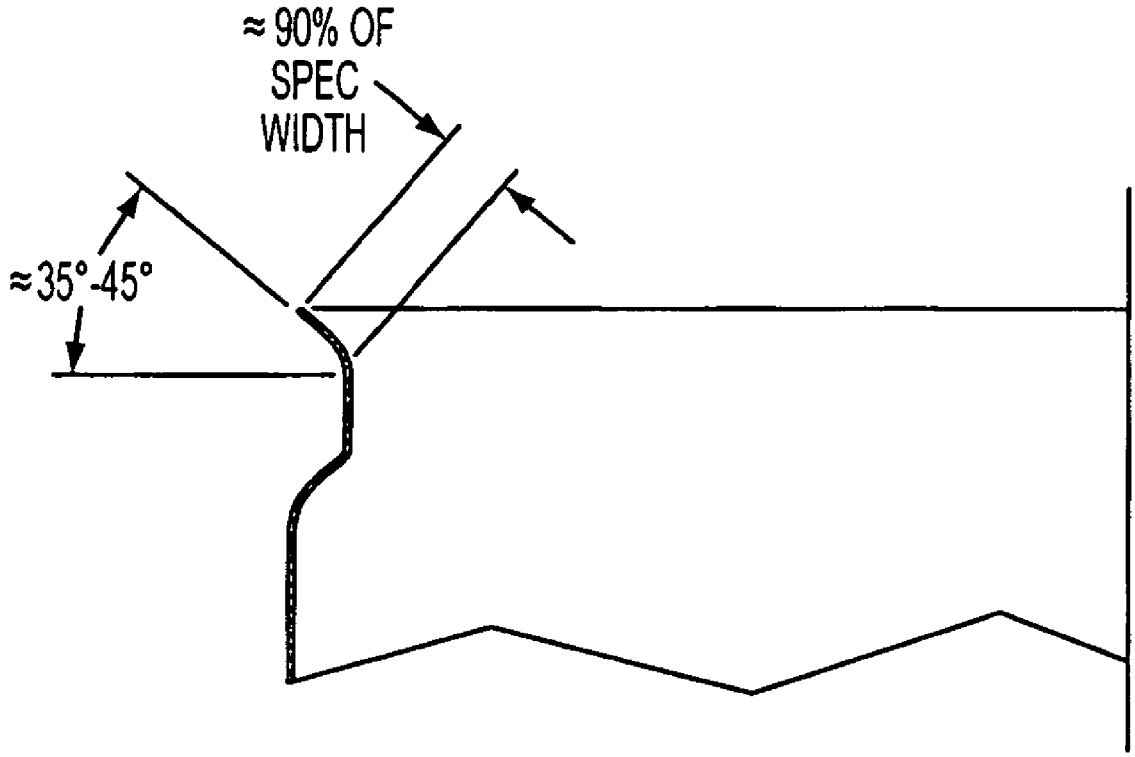
FIG. 6B is a schematic diagram showing the resulting flange after the $1^{st}$ stage process.

This initial stage will form the flange to within approximately 90% of the final size specification, leaving a flange angle of approximately 35–45 degrees (for example) and an under flange radius of approximately 0.080" (for example) (See FIG. 6B).

Figure 3A:
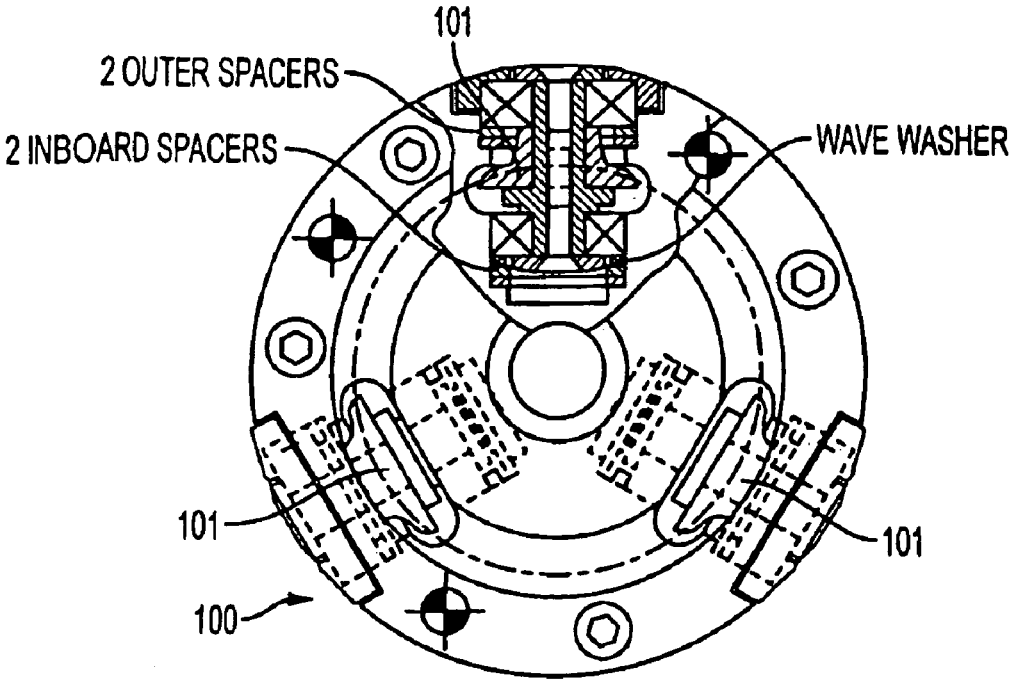
FIGS. 3A and 3B are elevations of radial spinhead assemblies which are configured for two different can sizes.
Figure 3B:
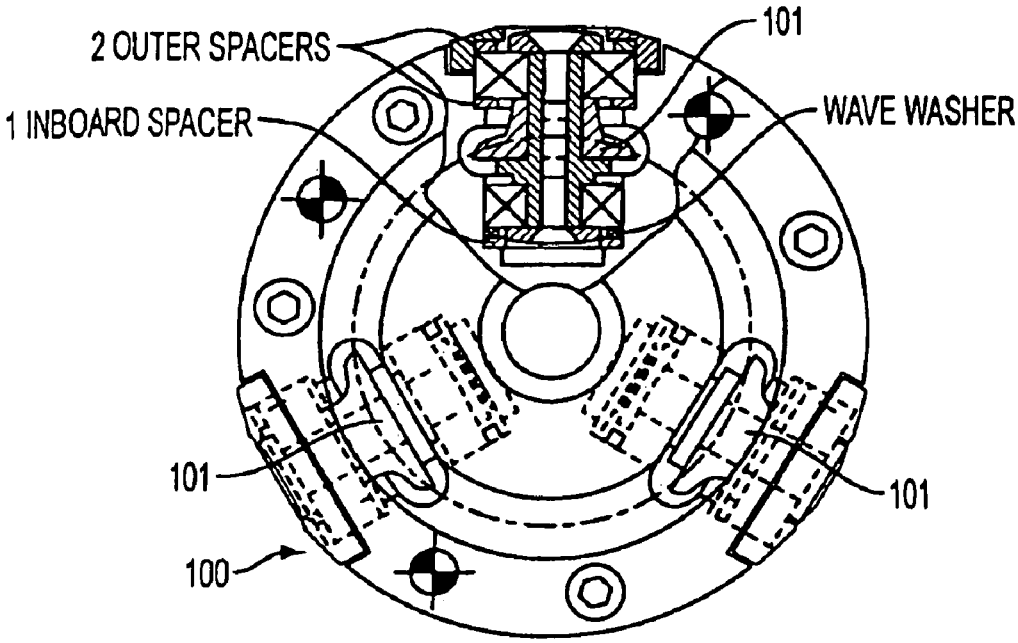
Figure 4:
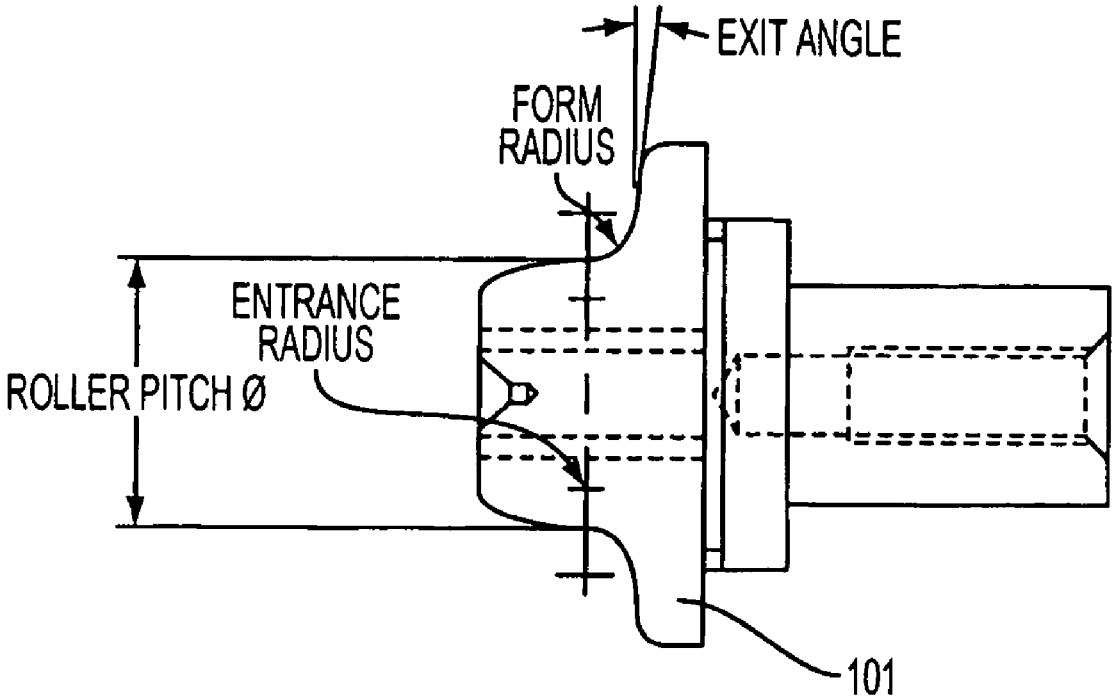
FIG. 4 is a side elevation showing a typical profile of spinhead roller.
Figure 5A:
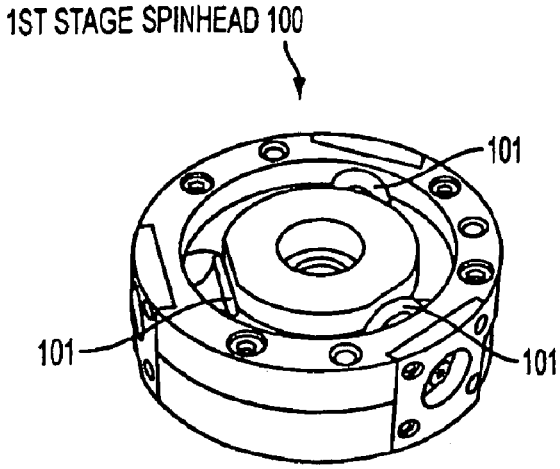
FIGS. 5A and 5B are perspective view showing a $1^{st}$ stage radial spinhead assembly and $2^{nd}$ stage die assembly.
Figure 5B:
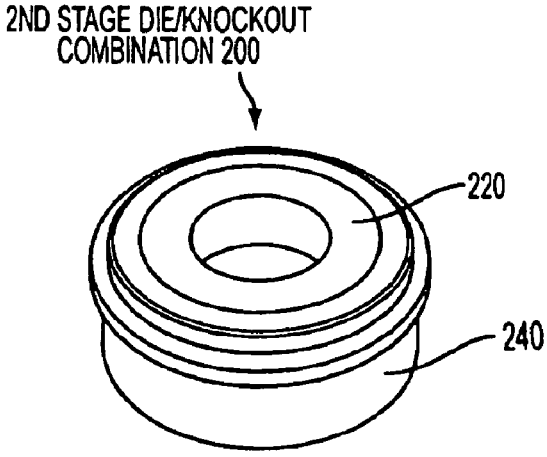

As will be appreciated from FIGS. 3A and 3B, the radial spin head 100 is arranged so that adjusting the number of inboard and outboard spacers which are associated with each of the rollers 101 permits the spin head to be adjusted for use with cans wherein the dimensions of the plug diameter varies.

Stage-2

Figure 7A:
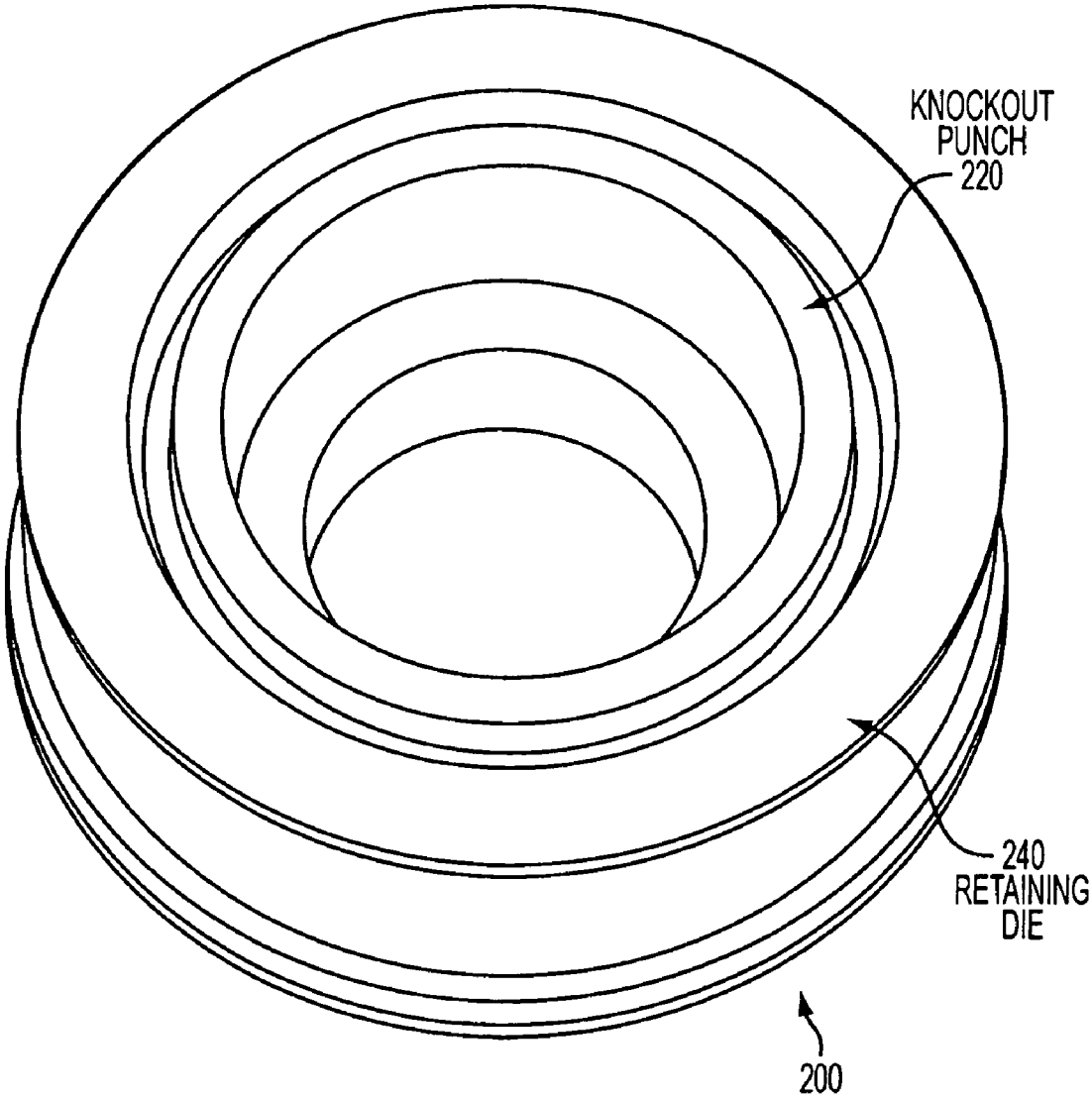
FIGS. 7A and 7B are perspective views showing 2 basic components of the $2^{nd}$ stage die/knockout tooling in assembled and dissembled states respectively.
Figure 7B:
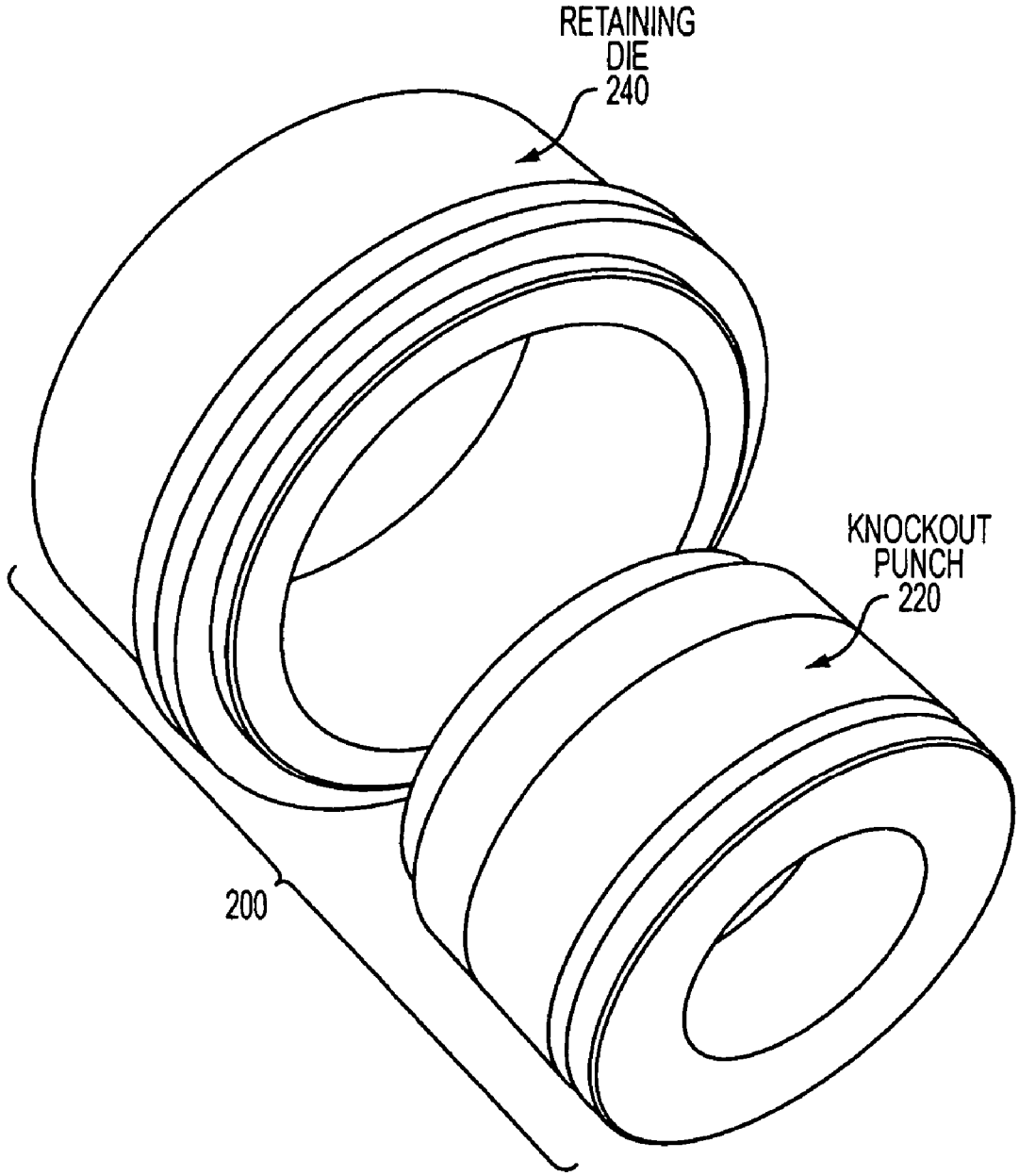
Figure 7C:
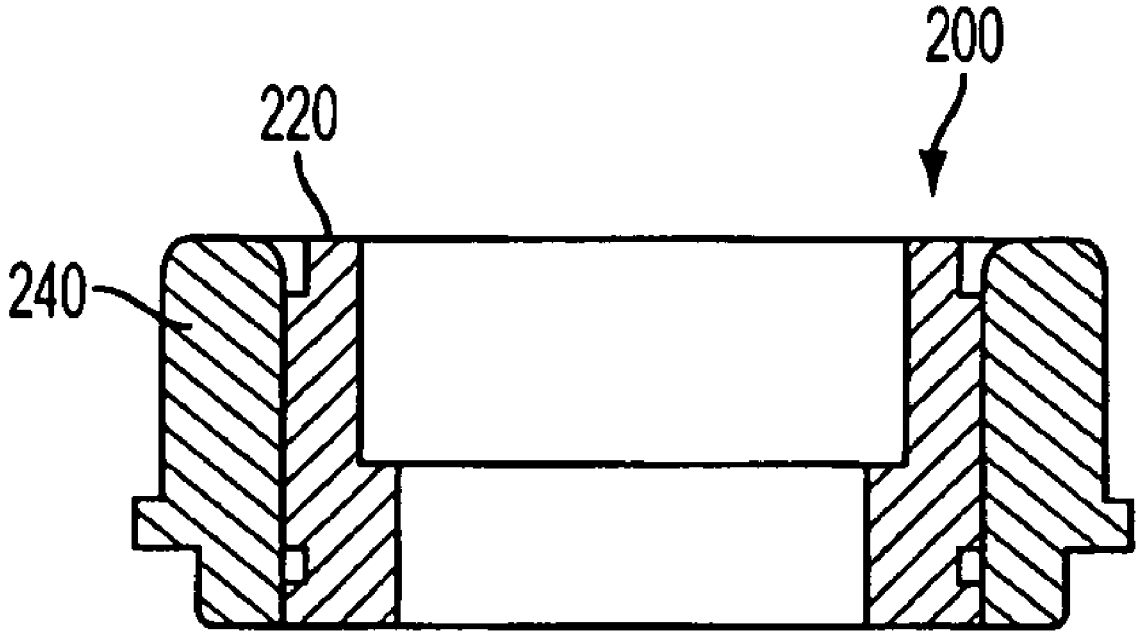
FIG. 7C is a sectional view of a the $2^{nd}$ stage arrangement depicted in FIGS. 7A and 7B.

This stage consists of two basic components: (See FIGS. 7A, 7B, and 7C)

Figure 1A:
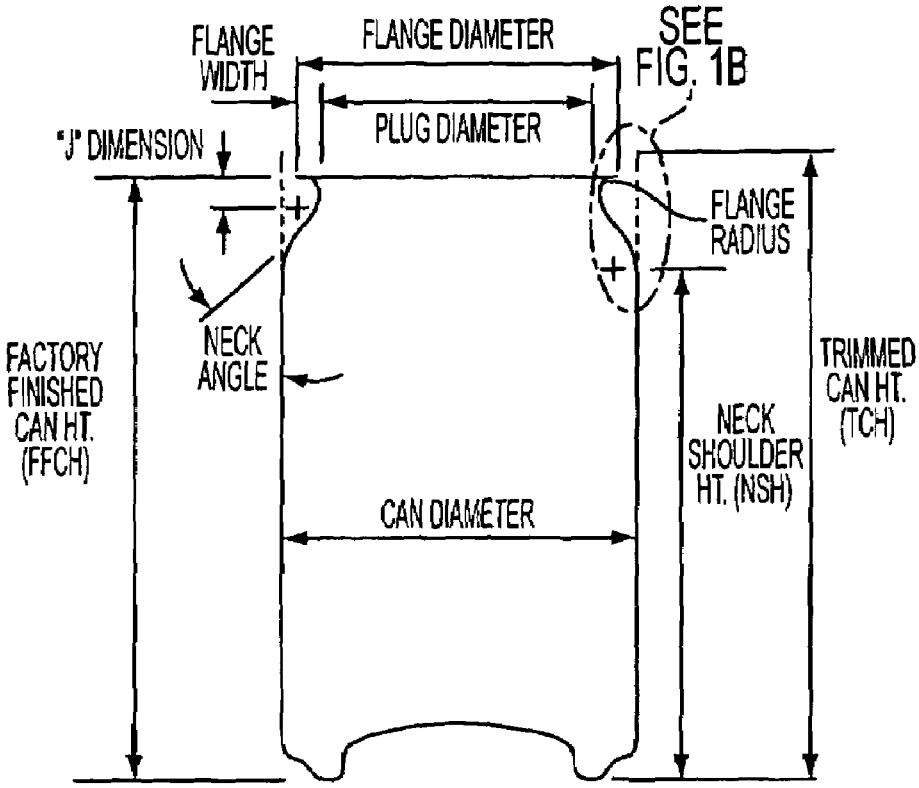
FIGS. 1A, 1B and 1C are diagrams showing flanged can definitions.
Figure 1B:
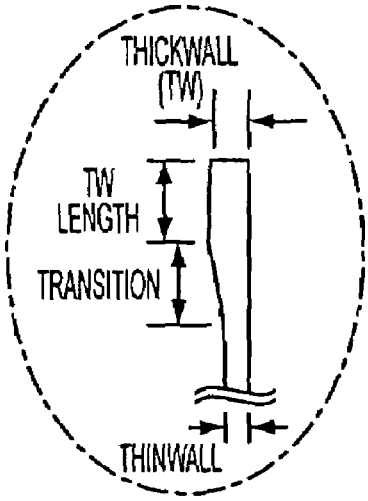
Figure 1C:
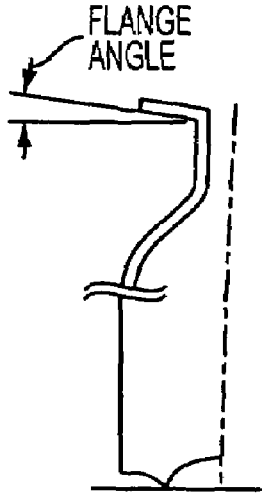
Figure 7D:
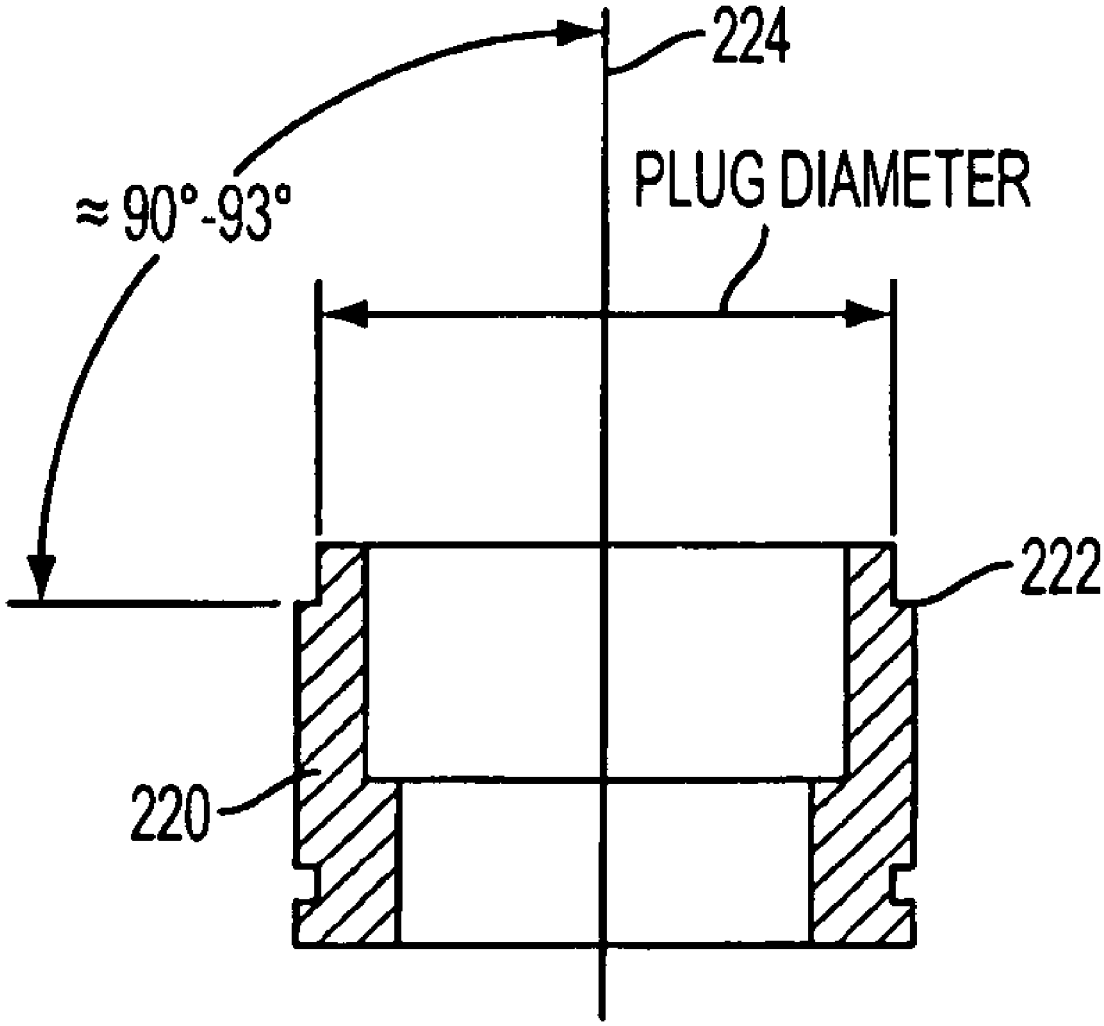
FIG. 7D is a sectional view of a $2^{nd}$ stage knockout punch.

A center knockout punch 220 with an outside diameter equaling the specified final plug diameter (see FIG. 1) and a stepped surface 222 which is approximately 0–3 degrees off perpendicular to the axis 224 of the center knockout punch 220 (see FIG. 7D). This is similar to the 3-degree exit angle of common spin rollers. There is no radius between the outside diameter and the step.

Figure 7E:
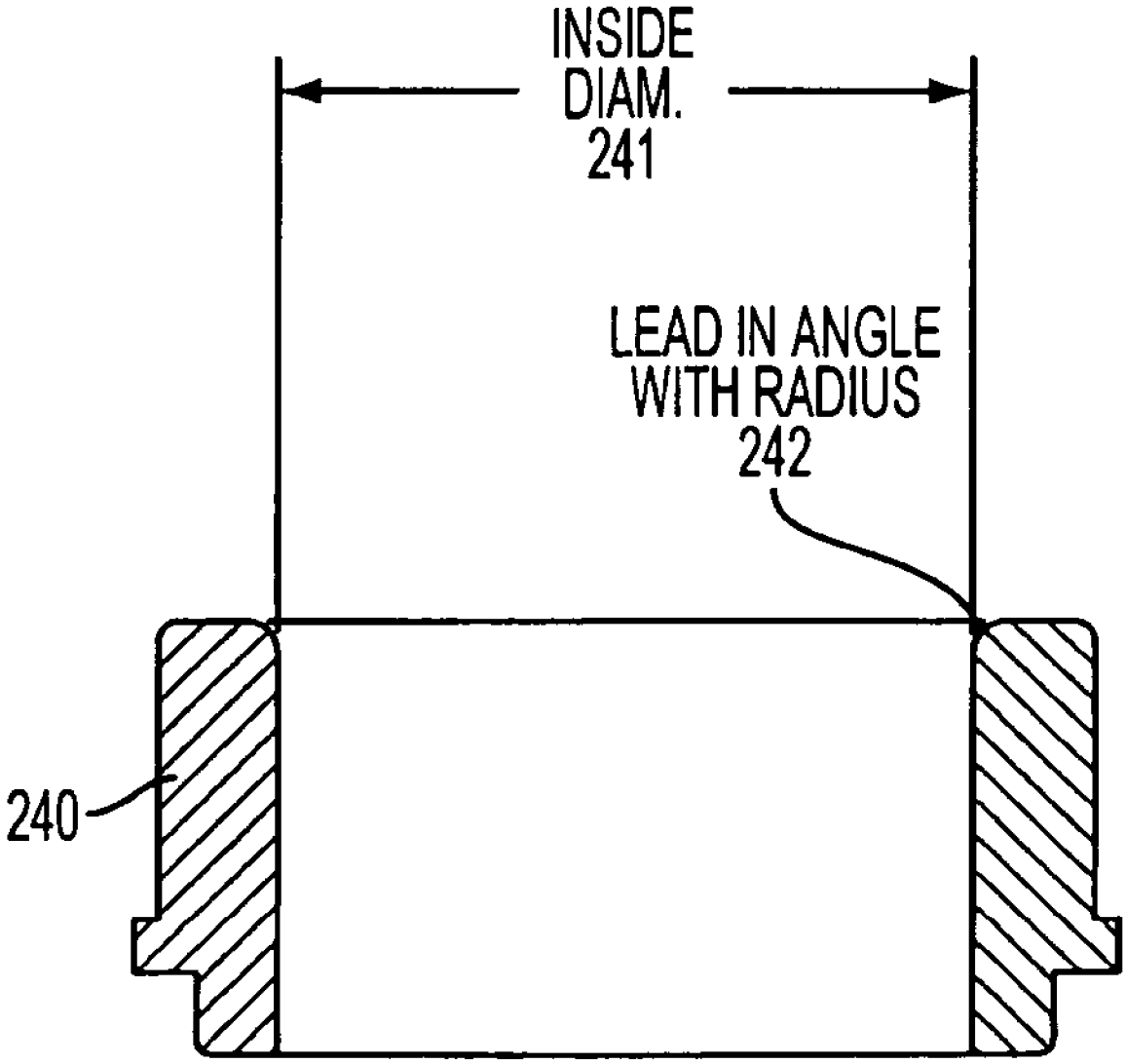
FIG. 7E is a sectional view of a $2^{nd}$ stage retaining die.

A retaining die 240 is, as shown in FIG. 7E, provided with an inside diameter 241 equaling the specified flange outside diameter. A generous lead-in angle is provided with a radius 242 selected to ensure the incoming flange doesn't hang or "knock" against the tooling (viz., the retaining die 240).

Mounting of the second stage tooling 200 is essentially similar to that of standard necking dies, where the die is retained on the threads of the knockout bushing with a threaded retaining ring. As in conventional necking, compressed air is used to maintain position and strength of the can throughout the process, while vacuum at the push plate, along with residual compressed air, ensure the can exits the tool. The can does not rotate.

Unlike the first flanging stage, the tooling (flattening die) does not rotate in the second stage.

In the final flattening process, the inside of the can, at the under flange radius, has no contact with the tooling at any point. When the partially formed flange is forced into the die, the stepped surface of the knockout produces the FFCH and the retaining die limits the size of the flange outside diameter. The under flange radius decreases from the initial 0.070"–0.080" (for example) to a nominal 0.035" (for example).

The absorption of necked can height variation is manifested through a greater variability of under flange radius.

Further background information pertaining to the environment in which the above type of arrangements are used can be found in U.S. Pat. No. 5,467,628 issued on Nov. 21, 1995 in the name of Bowlin et al., and U.S. Pat. No. 6,167,743 issued on Jan. 2, 2001 in the name of Marritt et al. The content of these documents is hereby incorporated by reference.

Even though the invention has been described with reference to a limited number of embodiments, the various changes and modifications which can be made without departing from the scope of the invention, which is limited only the appended claims, will be immediately self evident to a person of skill in the art to which the present invention pertains, given the preceding disclosure.

Figure 2A:
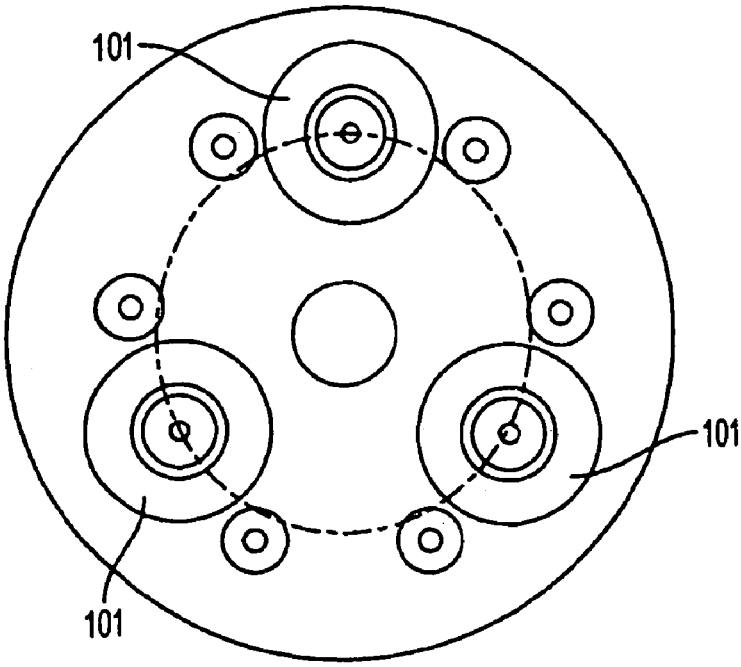
FIGS. 2A and 2B are front and side elevations of an axial type spin head assembly.
Figure 2B:
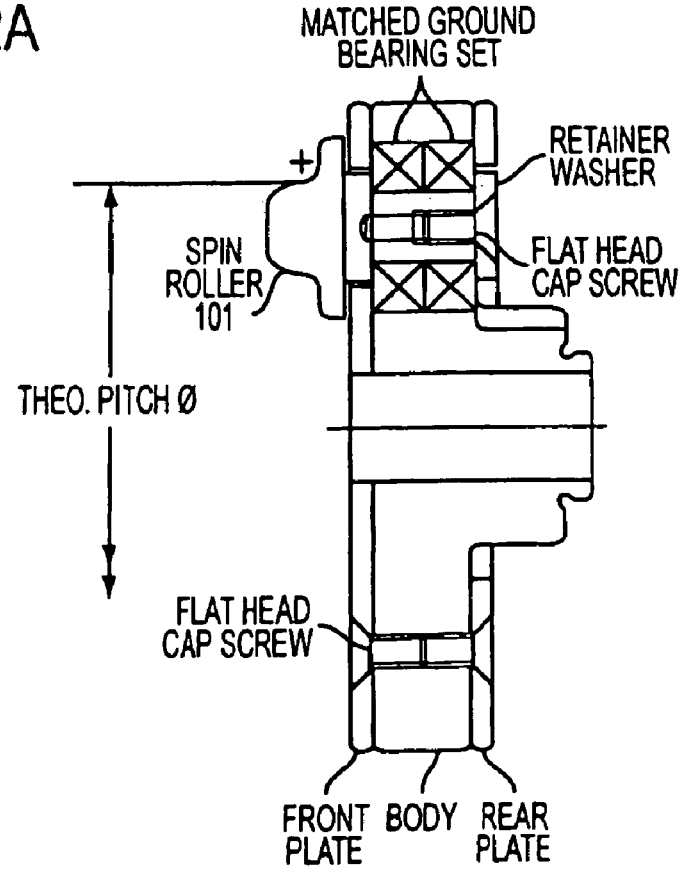

For example, even though stage 1 has been described in connection with the use of an radial spin head such as spin head 100, it is within the scope of the present invention to use an axial spin head such as that depicted in FIGS. 2A and 2B.

What is claimed is:

1. A flange forming process comprising first and second stages, wherein the first stage comprises:

forming a partially formed flange on a can; and wherein the second stage comprises:

modifying the partially formed flange by forcing the partially formed flange into a die so that a stepped surface of a knockout punch that is disposed in the die, produces a predetermined can height and so that a retaining die which is disposed with the knockout punch, limits the size of the flange outside diameter to a specified flange outer diameter.

2. A flange forming process as set forth in claim 1, wherein the step of producing the partially formed flange comprises using a radial spinhead having a plurality of rollers which each have a profile configured to partially form the flange.

3. A flange forming process as set forth in claim 2, comprising configuring each of the plurality of rollers to have an exit angle of about 30–40 degrees.

4. A flange forming process as set forth in claim 1, wherein the retaining die has an inside diameter equaling a predetermined flange outside diameter and which has a lead-in angle with a radius sufficient to avoid interference with the incoming flange.

5. A flange forming process as set forth in claim 1, wherein the center knockout punch has an outside diameter equaling a predetermined final plug diameter and has a stepped surface which has a predetermined angle with respect to the axis of the center knockout punch.

6. A flange forming process as set forth in claim 5, wherein the predetermined angle is from about 0 degrees to about 3 degrees off perpendicular with respect to the axis of the center knockout punch.

7. A flange forming process as set forth in claim 5, further comprising maintaining the retaining die and the can in a non-relative rotational relationship to one another using pneumatic pressure.

8. A flange forming process as set forth in claim 1, wherein the step of modifying comprises forcing the partially formed flange into the die so that the flange engages the stepped surface of the knockout and shapes the flange in a manner to produce the predetermined can height and so that the retaining die limits the size of the flange outside diameter during the modification.

9. A flange forming process as set forth in claim 1, wherein the first and second stages are respectively carried out in first and second turrets and further comprising moving the can from the first turret to the second turret after producing the partially formed flange.

10. A flange forming arrangement comprising first and second stages, wherein the first stage comprises:

a spinhead having a plurality of rollers with profiles configured to produce a partially formed flange on a can; and wherein the second stage comprises:

a center knockout punch with an outside diameter equal to a specified final plug diameter of the can, and a stepped surface, the stepped surface having a predetermined angle with respect to an axis of the center knockout punch, and a retaining die disposed with the center knockout punch, the retaining die having an inside diameter equal to a specified flange outside diameter and a lead-in angle with a radius configured to ensure the incoming flange is free of engagement with the second retaining die until it reaches the stepped surface.

11. A flange forming arrangement as forth in claim 10, wherein each of the rollers has a configuration wherein the exit angle is about 30–40 degrees.

12. A flange forming arrangement as set forth in claim 10, wherein the second stage is configured so that the partially formed flange is received in the retaining die and is advanced thereinto so that the stepped surface produces a predetermined can height, and so that the retaining die limits the size of the flange outside diameter to the specified flange outside diameter.

13. A flange forming arrangement as set forth in claim 12, wherein the predetermined angle of the stepped surface is 0–3 degrees off perpendicular with respect to the axis of the center knockout punch.

14. A flange forming arrangement as set forth in claim 10, wherein the first stage is mounted on a first turret and wherein the second stage is mounted on a second turret.

15. A flange forming arrangement as set forth in claim 10, wherein the spin head is one of a radial spin head and an axial spin head.

16. A flange forming process comprising first and second stages, wherein the first stage comprises:

means for forming a partially formed flange on a can; and wherein the second stage comprises:

means for modifying the partially formed flange by forcing the partially formed flange into a die so that a stepped surface of a knockout punch that is disposed in the die, produces a predetermined can height and so that a retaining die which is disposed with the knockout punch, limits the size of the flange outside diameter to a specified flange outer diameter.

17. A flange forming process as set forth in claim 16, wherein the means for forming the partially formed flange comprises one of an axial spin head and a radial spin head.

18. A flange forming process as set forth in claim 17, wherein one of the axial spin head and the radial spin head are used on a common turret.

* * * * *